US010716403B1

(12) United States Patent
McCarville et al.

(10) Patent No.: US 10,716,403 B1
(45) Date of Patent: Jul. 21, 2020

(54) COLLAPSIBLE AND PORTABLE SEATING APPARATUS

(71) Applicants: Robert McCarville, Omaha, NE (US); Kristen McCarville, Omaha, NE (US)

(72) Inventors: Robert McCarville, Omaha, NE (US); Kristen McCarville, Omaha, NE (US)

( * ) Notice: Subject to any disclaimer, the term of this patent is extended or adjusted under 35 U.S.C. 154(b) by 0 days.

(21) Appl. No.: 16/127,021

(22) Filed: Sep. 10, 2018

Related U.S. Application Data

(60) Provisional application No. 62/556,209, filed on Sep. 8, 2017.

(51) Int. Cl.

| | |
|---|---|
| ***A47C 11/00*** | (2006.01) |
| ***A47C 7/62*** | (2006.01) |
| ***G09F 19/00*** | (2006.01) |
| ***A47C 7/00*** | (2006.01) |
| *G09F 9/30* | (2006.01) |

(52) U.S. Cl.
CPC ..... *A47C 11/005* (2013.01); *A47C 7/006* (2013.01); *A47C 7/62* (2013.01); *G09F 19/00* (2013.01); *G09F 9/30* (2013.01)

(58) Field of Classification Search
CPC ..... A47C 11/005; A47C 7/006; A47C 7/62; G09F 19/00; G09F 9/30
USPC ..... 297/217.3, 158.3–158.5, 159.1
See application file for complete search history.

(56) References Cited

U.S. PATENT DOCUMENTS

| | | | | |
|---|---|---|---|---|
| 3,107,442 | A | 10/1963 | Levine | |
| 3,337,262 | A | 8/1967 | Katzfey et al. | |
| 3,477,760 | A | 11/1969 | Bue et al. | |
| 3,511,532 | A * | 5/1970 | Tringali | A47B 3/14 297/158.4 |
| 6,065,802 | A | 5/2000 | Bue | |
| 6,830,294 | B2 * | 12/2004 | Berthiaume | A47C 1/12 108/168 |
| 7,611,193 | B2 | 11/2009 | Bue et al. | |
| 7,922,245 | B1 * | 4/2011 | Sawhney | A47B 3/14 297/158.4 |
| 7,980,858 | B2 * | 7/2011 | Valoe | E04H 3/08 434/432 |

* cited by examiner

*Primary Examiner* — Mark R Wendell
(74) *Attorney, Agent, or Firm* — Suiter Swantz pc llo

(57) ABSTRACT

A collapsible and portable seating apparatus is disclosed. The apparatus includes two or more seat assemblies. A first seat assembly is mechanically coupled to a second seat assembly. Each seat assembly includes a hinge assembly. The apparatus includes a display assembly mechanically coupled to the two or more seat assemblies. The display assembly includes a display device. The apparatus includes two or more wheeled-supports. The two or more wheeled-supports are mechanically coupled to the seat assemblies. The seat assemblies are collapsible at each of hinged assemblies and the seat assemblies. The two or more seating assemblies and the display assembly are portable via the one or more wheeled supports.

19 Claims, 11 Drawing Sheets

COLLAPSIBLE AND PORTABLE SEATING APPARATUS

CROSS-REFERENCE TO RELATED APPLICATION

The present application claims the benefit under 35 U.S.C. § 119(e) of U.S. Provisional Application Ser. No. 62/556,209, filed Sep. 8, 2017, entitled COLLAPSIBLE AND PORTABLE SEATING APPARATUS, naming Robert McCarville and Kristen McCarville as inventors, which is incorporated herein by reference in the entirety.

TECHNICAL FIELD

The present invention generally relates to seating and, more particularly, to a collapsible and portable seating apparatus.

BACKGROUND

During a variety of sports games, coaches discuss potential strategies with players during a time-out period. Often, the players may sit in chairs, while the coach references illustrations shown on a pad or a board. To reduce the amount of time it takes to set up the chairs and/or the board during the time-out period, multiple individuals may carry the chairs and/or push the board out for the players and the coach. This set-up can cost the coach and team time during the time-out period, and may require otherwise needed space to be reserved for the individuals carrying out the chairs to sit on the side of the sports court or field. As such, it would be desirable to provide an apparatus that addresses the shortcomings of the previous approaches provided above.

SUMMARY

A collapsible and portable seating apparatus is disclosed, in accordance with one or more embodiments of the present disclosure. In one embodiment, the apparatus includes two or more seat assemblies. In another embodiment, a first seat assembly is mechanically coupled to a second seat assembly. In another embodiment, each seat assembly includes a hinge assembly. In another embodiment, the apparatus includes a display assembly mechanically coupled to the two or more seat assemblies, wherein the display assembly includes a display device. In another embodiment, the apparatus includes two or more wheeled-supports, wherein the two or more wheeled-supports are mechanically coupled to the two or more seat assemblies. In another embodiment, the two or more seat assemblies are collapsible at the two or more hinged assemblies and the two or more seat assemblies. In another embodiment, the two or more seating assemblies and the display assembly are portable via the one or more wheeled supports.

A collapsible and portable seating apparatus is disclosed, in accordance with one or more additional and/or alternative embodiments of the present disclosure. In one embodiment, the apparatus includes a first seat assembly, wherein the first seat assembly includes a first set of seats and a second set of seats. In another embodiment, the apparatus includes a second seat assembly, wherein the second seat assembly includes a third set of seats and a fourth set of seats. In another embodiment, the apparatus includes a first hinge assembly disposed between the first set of seats and the second set of seats of the first seat assembly. In another embodiment, the apparatus includes a second hinge assembly disposed between the third set of seats and the fourth set of seats of the second seat assembly. In another embodiment, the apparatus includes a display assembly, wherein the display assembly includes a display device. In another embodiment, the apparatus includes a horizontal support member configured to mechanically couple the first seat assembly to the second seat assembly and further configured to support the display assembly. In another embodiment, the apparatus includes a first set of wheeled-supports, wherein the first set of wheeled-supports is mechanically coupled to the first seat assembly. In another embodiment, the apparatus includes a second set of wheeled-supports, wherein the second set of wheeled-supports is mechanically coupled to the second seat assembly. In another embodiment, the first seat assembly and the second seat assembly are collapsible at the first hinge assembly and the second hinge assembly. In another embodiment, the two or more seating assemblies and the display assembly are portable via the one or more wheeled supports. In another embodiment, the first seat assembly, the second seat assembly, the first set of wheeled-supports, and the second set of wheeled-supports are configured to raise one or more wheels of the two or more wheeled-supports off of the ground and engage one or more supports of the two or more seat assemblies with the ground when in an uncollapsed configuration.

A collapsible and portable seating apparatus is disclosed, in accordance with one or more additional and/or alternative embodiments of the present disclosure. In one embodiment, the apparatus includes two or more seat assemblies. In another embodiment, a first seat assembly is mechanically coupled to a second seat assembly, wherein each seat assembly includes a hinge assembly. In another embodiment, the apparatus includes a display assembly mechanically coupled to the two or more seat assemblies, wherein the display assembly includes a display device and one or more markable surfaces. In another embodiment, the apparatus includes a user interface device, wherein the user interface device is communicatively coupled to the display device of the display assembly. In another embodiment, the apparatus includes two or more wheeled-supports, wherein the two or more wheeled-supports are mechanically coupled to the two or more seat assemblies. In another embodiment, the two or more seat assemblies are collapsible at the two or more hinged assemblies and the two or more seat assemblies. In another embodiment, the two or more seating assemblies and the one or more display assemblies are portable via the one or more wheeled supports.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the disclosure may be better understood by those skilled in the art by reference to the accompanying figures in which.

DETAILED DESCRIPTION OF THE INVENTION

Reference will now be made in detail to the subject matter disclosed, which is illustrated in the accompanying drawings.

FIGS. 1-7B generally illustrate a collapsible and portable seating apparatus, in accordance with one or more embodiments of the present disclosure. Embodiments of the present disclosure are directed to a collapsible and portable seating apparatus usable in a variety of indoor and outdoor environments. Such environments include, but are not limited to, indoor and/or outdoor sport events (e.g., basketball, football, soccer, lacrosse, etc.). The apparatus of the present disclosure may also be implement in non-sports contexts such as, but not limited to, educational settings, medical settings, film production, etc. Embodiments of the present disclosure are also directed to the process of collapsing a collapsible and portable seating apparatus and/or the storage of the apparatus.

In one aspect, the collapsible and portable seating apparatus is collapsible and/or foldable from a stored or transportable form to an operational form. For example, the seating apparatus may collapse into a stored or transportable form, which reduces the footprint of the seating apparatus to a fraction of the original footprint and results in less space necessary to store and/or transport the seating apparatus. In another aspect, the seating apparatus is transformable from the stored or transportable form to the operational form via a single operator. In another aspect, the collapsible and portable seating apparatus is movable and/or portable from a storage location (e.g., either long-term or short-term) to a location of operation via a single operator.

Figure 1:
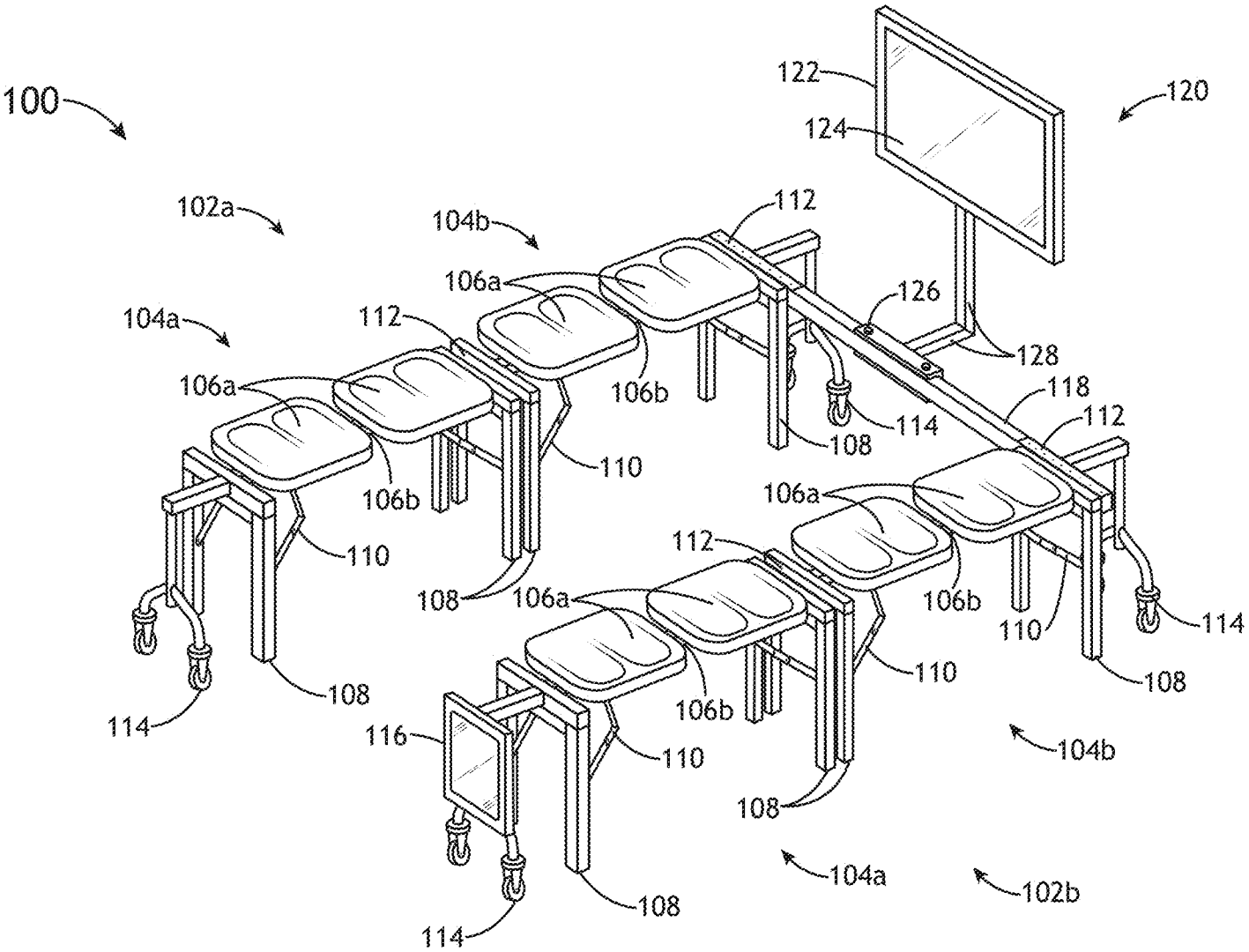
FIG. 1 illustrates a collapsible and portable seating apparatus, in accordance with one or more embodiments of the present disclosure.

FIG. 1 illustrates a collapsible seating apparatus 100, in accordance with one or more embodiments of the present disclosure. In one embodiment, the apparatus 100 includes one or more seat assemblies. For example, the apparatus 100 may include, but is not limited to, a first seat assembly 102*a* and a second seat assembly 102*b*. It is noted herein that the description of the various embodiments of the first seat assembly 102*a*, provided throughout the present disclosure, should be interpreted to extend to the second seat assembly 102*b*.

In one embodiment, the first seat assembly 102*a* includes one or more sets of one or more seats. For example, the first seat assembly 102*a* may include, but is not limited to, a first set 104*a* of one or more seats 106*a* (e.g., one seat, two seat, three seats, and so on) and a second set 104*b* of one or more seats 106*a*. It is noted herein that the description of the various embodiments of the first set 104*a* of seats, provided throughout the present disclosure, should be interpreted to extend to the second set 104*b* of seats.

In one embodiment, the one or more seats 106*a* are substantially flat surfaces. In another embodiment, the one or more seats 106*a* include one or more contours and/or depressions, whereby the contours and/or depressions conform to a user. In another embodiment, the one or more seats 106*a* are of any shape known in the art (e.g., circular, rectangular, or the like). In another embodiment, one or more cushions are coupled to the one or more seats 106*a*.

In another embodiment, the first set 104*a* of one or more seats 106*a* are coupled to one or more support rails 106*b*. In another embodiment, the one or more support rails 106*b* couple the first set 104*a* of one or more seats 106*a* to at least one of the one or more supports 108 and/or the one or more wheeled-supports 114. It is noted herein the one or more support rails 106*b* may include any cross-section known in the art. For example, the one or more support rails 106*b* may include, but are not limited to, a circular cross-section, an elliptic cross-section, a polygonal cross-section (e.g., square, rectangle, triangle, hexagonal, etc.), or the like.

In another embodiment, the one or more supports 108 are coupled to the one or more support rails 106*b* via one or more linkage assemblies 110. For example, the one or more supports 108 may rotate from an orientation substantially perpendicular to the one or more support rails 106*b* to an orientation substantially parallel to the one or more support rails 106*b* via the one or more linkage assemblies 110.

In another embodiment, the first set 104*a* of seats and the second set 104*b* of seats of the first seat assembly 102*a* are coupled together via one or more hinge assemblies 112. In another embodiment, the first seat assembly 102*a* and the second seat assembly 102*b* are coupled together via a support member 118. In another embodiment, the first seat assembly 102*a* and the second seat assembly 102*b* are coupled to the support member 118 via one or more hinge assemblies 112.

In another embodiment, the apparatus 100 includes one or more wheeled-supports 114. For example, the one or more wheeled-supports 114 may be shorter than the one or more supports 108 such that the one or more wheeled-supports 114 engage the ground when the apparatus 100 is in a collapsed or partially-collapsed form, and are lifted off of the ground when the apparatus is in an uncollapsed form. By way of another example, the one or more wheeled-supports 114 are the same length as the one or more supports 108 such that the one or more wheeled-supports always the engage the ground. By way of another example, the one or more wheeled-supports 114 may be longer than the one or more supports 108. In this regard, the apparatus 100 may be transported and/or stored in a collapsed or an expanded (e.g., uncollapsed) form with a reduced amount of effort from a user. It is noted herein the one or more wheeled-supports 114 may include one or more linkage assemblies 110.

In another embodiment, the apparatus 100 includes one or more lock assemblies to keep the apparatus in a collapsed form. In another embodiment, the apparatus 100 includes one or more lock assemblies to keep the apparatus 100 in a non-collapsed form.

In another embodiment, one or more display assemblies 120 are coupled to the support member 118 via a bracket 126 and one or more display support members 128. It is noted herein the one or more display support members 128 may be designed such that the one or more display assemblies 120 are orientated substantially perpendicular to the rows defined by the seat assemblies 102*a*, 102*b*. It is additionally noted herein the one or more display support members 128 may be designed such that the one or more display assemblies 120 are at a selected height from the ground (e.g. a height for comfortable viewing by users sitting on the seat assemblies 102*a*, 102*b*). In another embodiment, the one or more display support members 128 are articulating to allow height and/or viewing angle adjustment.

In another embodiment, the apparatus 100 may include one or more brace structures for stabilizing the apparatus 100 (e.g., prevent the seat assemblies 102*a*, 102*b* from moving side-to-side relative to each other). For example, the one or more supports 108, the one or more wheeled-supports 114, the support member 118, and/or the one or more members 128 may include any number of brace structures necessary to stabilize the apparatus 100. For instance, the apparatus 100 may include one or more couplers located between the sets of supports 108 of the seat assemblies 102*a*, 102*b*. In another instance, the apparatus 100 may include one or more latching components that latch onto or embed within the ground surface (e.g., one or more spikes).

It is noted herein the one or more supports 108, the one or more wheeled-supports 114, the support member 118, and/or the one or more members 128 may have any cross-section known in the art. For example, the one or more wheeled-supports 114, the support member 118, and/or the one or more members 128 may include, but are not limited to, a circular cross-section, an elliptic cross-section, a polygonal cross-section (e.g., square, rectangle, triangle, hexagonal, etc.), or the like.

In another embodiment, the one or more display assemblies 120 include a markable surface 122. For example, the one or more display assemblies 120 may include only a markable surface 122.

In another embodiment, the one or more display assemblies 120 include a display device 124. For example, the one or more display assemblies 120 may include only a display device 124.

In another embodiment, the one or more display assemblies 120 include both the markable surface 122 and the display device 124. For example, the display device 124 may be embedded underneath and visible through the markable surface 122 such that a user may effectively mark the display device 124 by marking on the markable surface 122. In this regard, the markable surface may act as an overlay over the display device 124 allowing a user to make markings on the markable surface with reference to pictorial/video data presented beneath the markable surface on a screen of the display device 124. By way of another example, the display device 124 may be embedded within the markable surface 122 such that a surface of the display device 124 and the markable surface 122 are substantially flush. By way of another example, the display device 124 may be embedded within the markable surface 122 such that the display device 124 is inset within the markable surface 122 a selected depth.

In another embodiment, the display device 124 may receive digital marking information via the user interface (e.g., tablet, smartphone, a digital pen, etc.). In this embodiment, the display device 124 is communicatively coupled/couplable to the user input device. For example, the display device 124 may be coupled to the user input device via a wireline and/or wireless data link. In the case of a wireless communication link, the display device 124 and the user input device may be communicatively coupled via any wireless protocol known in the art, such as, but not limited to, Low Energy Blue Tooth, WiFi, and etc.

The user input device may include any user input device known in the art. For example, the user input device may include, but is not limited to, a touchscreen of a mobile communication device (e.g., tablet, smartphone, ultrabook, etc.) communicatively coupled with the display device, a touchscreen of the display device 124, a digital pen interactable with the display device 124, a digital pen interactable with a mobile communication device communicatively coupled with the display device, a keyboard, a keypad, a lever, a knob, a scroll wheel, a track ball, a switch, a dial, a sliding bar, a scroll bar, a slide, a handle, a touch pad, a paddle, a steering wheel, a joystick, a bezel input device or the like. In the case of a touchscreen interface, those skilled in the art should recognize that a large number of touchscreen interfaces may be suitable for implementation in the apparatus 100. For instance, the display device may be integrated with a touchscreen interface, such as, but not limited to, a capacitive touchscreen, a resistive touchscreen, a surface acoustic based touchscreen, an infrared based touchscreen, or the like. In a general sense, any touchscreen interface capable of integration with the display portion of a display device is suitable for implementation in the present invention. In another embodiment, the user input device may include, but is not limited to, a bezel mounted interface.

The markable surface 122 may include, but is not limited to, a whiteboard surface, a chalkboard surface, a glass surface, a paper pad, a digital surface, or the like.

The display device 124 may include any display device known in the art. For example, the display device may include, but is not limited to, a liquid crystal display (LCD). By way of another example, the display device may include, but is not limited to, an organic light-emitting diode (OLED) based display. By way of another example, the display device may include, but is not limited to a CRT display. Those skilled in the art should recognize that a variety of display devices may be suitable for implementation in the present invention and the particular choice of display device may depend on a variety of factors, including, but not limited to, form factor, cost, and the like. In a general sense, any display device capable of integration with a user input device (e.g., touchscreen, bezel mounted interface, keyboard, mouse, trackpad, wireline/wireless linked tablet, and the like) is suitable for implementation in the apparatus 100.

In another embodiment, the apparatus 100 includes a controller. In another embodiment, the controller is communicatively coupled to one or more components of the apparatus 100. For example, the controller may be communicatively coupled, either directly or indirectly, to the markable surface 122, the display device 124, and/or the user input device. In another, the controller may be integrated within the markable surface 122, the display device 124, and/or the user input device. The controller may direct any of the components of the apparatus 100 to carry out any one or more of the various functions described throughout the present disclosure. In another embodiment, the controller includes one or more processors and memory. The memory may store one or more sets of program instructions. The one or more processors may be configured to execute the one or more sets of program instructions.

The controller may be configured to receive and/or acquire data or information from other systems or subsystems (e.g., one or more sets of information from the markable surface 122, the display device 124, and/or the user input device) of the apparatus 100 by a transmission medium that may include wireline and/or wireless portions. The controller may additionally be configured to transmit data or information (e.g., the output of one or more procedures of the inventive concepts disclosed herein) to one or more systems or sub-systems (e.g., one or more sets of information from the markable surface 122, the display device 124, and/or the user input device) of the apparatus 100 by a transmission medium that may include wireline and/or wireless portions. In this regard, the transmission medium may serve as a data link between the controller and the other subsystems of the apparatus 100. Additionally, the controller may be configured to send data to external systems via a transmission medium (e.g., network connection).

The one or more processors may include any one or more processing elements known in the art. In this sense, the one or more processors may include any microprocessor device configured to execute algorithms and/or program instructions. For example, the one or more processors may consist of a desktop computer, mainframe computer system, workstation, image computer, parallel processor, handheld computer (e.g. tablet, smartphone, or phablet), or other computer system (e.g., networked computer) configured to cause the apparatus 100 to perform one or more of the various steps described throughout the present disclosure. It should be recognized that the steps described throughout the present disclosure may be carried out by a single computer system or, alternatively, multiple computer systems. In general, the term "processor" may be broadly defined to encompass any device having one or more processing elements, which execute the one or sets of program instructions from a non-transitory memory medium (e.g., the memory). Moreover, different subsystems of the apparatus 100 (e.g., one or more sets of information from the markable surface 122, the display device 124, and/or the user input device) may include processor or logic elements suitable for carrying out at least a portion of the steps described throughout the present disclosure. Therefore, the above description should not be interpreted as a limitation on the present disclosure but merely an illustration.

The memory may include any storage medium known in the art suitable for storing the one or more sets of program instructions executable by the associated one or more processors to carry out the various steps described throughout the present disclosure. For example, the memory may include a non-transitory memory medium. For instance, the memory may include, but is not limited to, a read-only memory, a random access memory, a magnetic or optical memory device (e.g., disk), a magnetic tape, a solid state drive, and the like. The memory may be configured to provide display information to a display device of a user interface and/or the output of the various steps described throughout the present disclosure. The memory may additionally be configured to store user input information from a user input device of the user interface and/or the input from the various steps described throughout the present disclosure. The memory may be housed in a common controller housing with the one or more processors. The memory may, alternatively or in addition, be located remotely with respect to the physical location of the processors and/or the controller. For instance, the one or more processors and/or the controller may access a remote memory (e.g., server), accessible through a network (e.g., internet, intranet and the like).

In another embodiment, the first seat 106*a* of the first seat assembly 102*a* and/or the second seat assembly 102*b* includes one or more accessory mounts 116. For example, the one or more accessory mounts 116 may include, but are not limited to, a storage unit or holster for storing one or more marking devices for the markable surface 122 (e.g., chalk, whiteboard markers, styluses, or the like) or the user input device (e.g., electronic tablet, customized electronic communication device, and etc.) coupled to the display device 124, a mounting location for the user input device coupled to the display device 124, or the like.

In another embodiment, the apparatus 100 may be configured for being fastened or attached to a portion of a building. For example, a mating assembly may be installed on a wall of a building such that when in the collapsed form the apparatus 100 may be transported to the mating assembly and temporarily attached to the wall of the building via one or more brackets of the mating assembly. Such a mating assembly may be installed in the building during construction of the building or may be retrofitted into an already existing building.

Figure 2A:
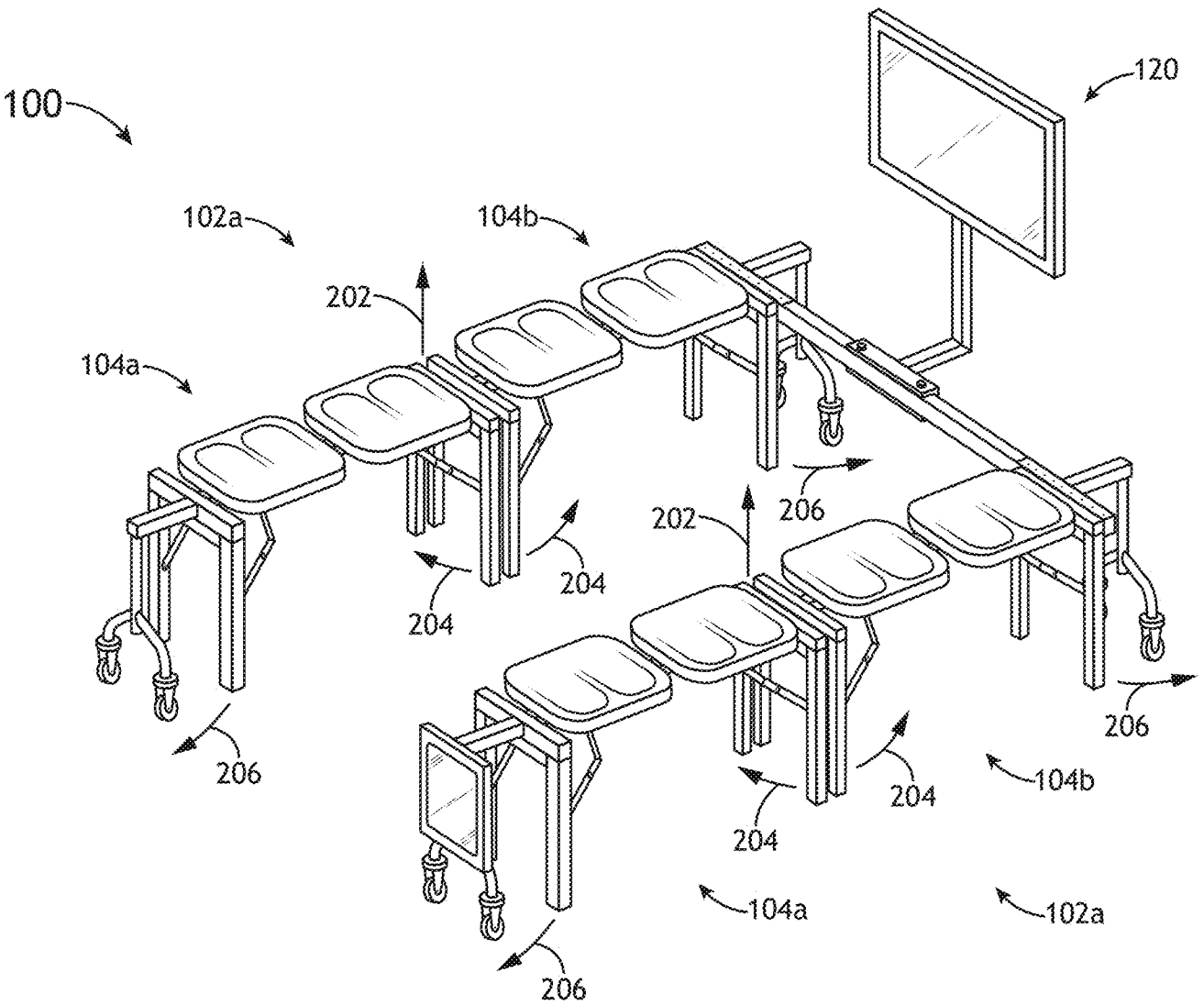
FIG. 2A illustrates a non-collapsed view of a collapsible and portable seating apparatus, in accordance with one or more embodiments of the present disclosure.
Figure 2B:
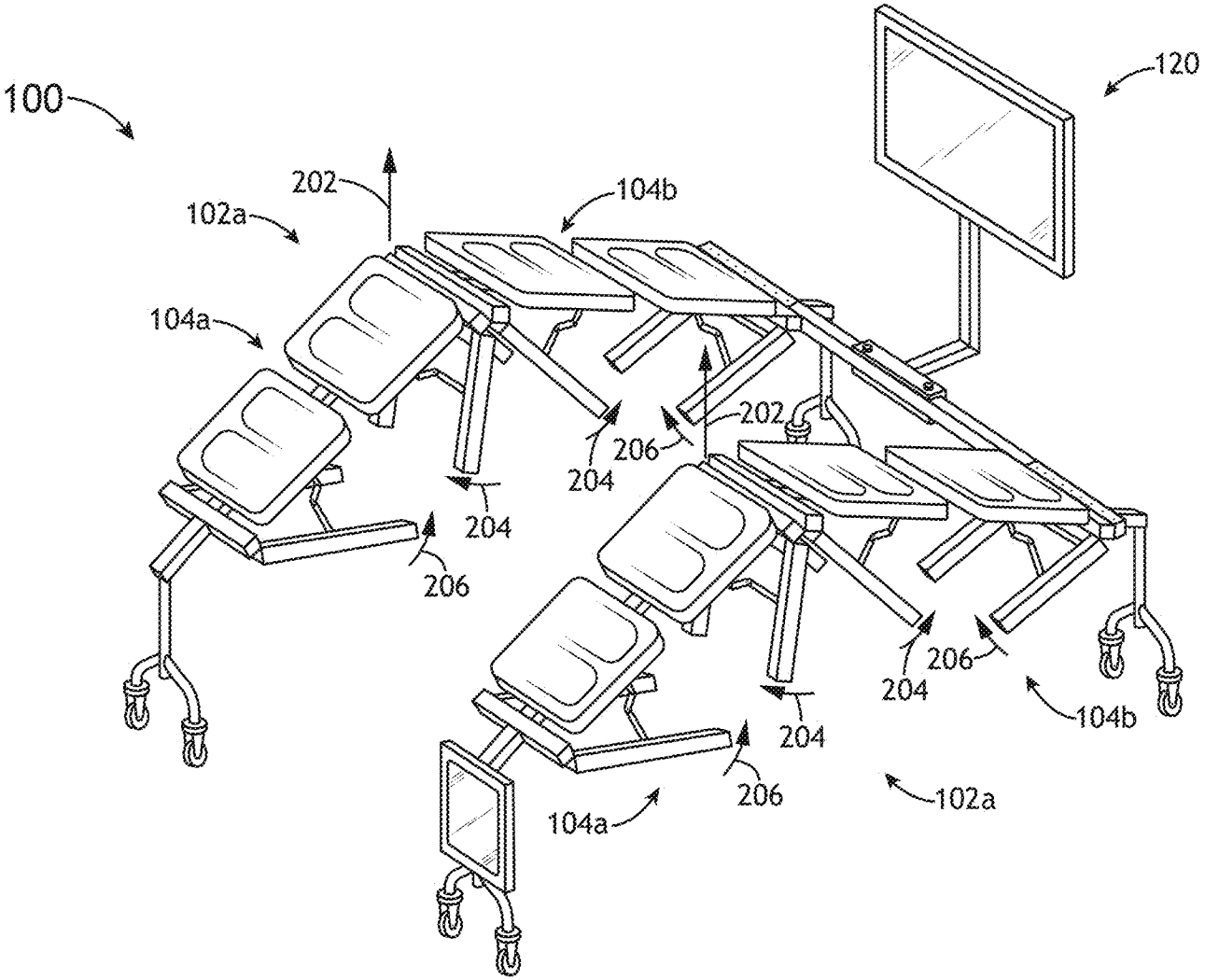
FIG. 2B illustrates a partially-collapsed view of a collapsible and portable seating apparatus, in accordance with one or more embodiments of the present disclosure.
Figure 2C:
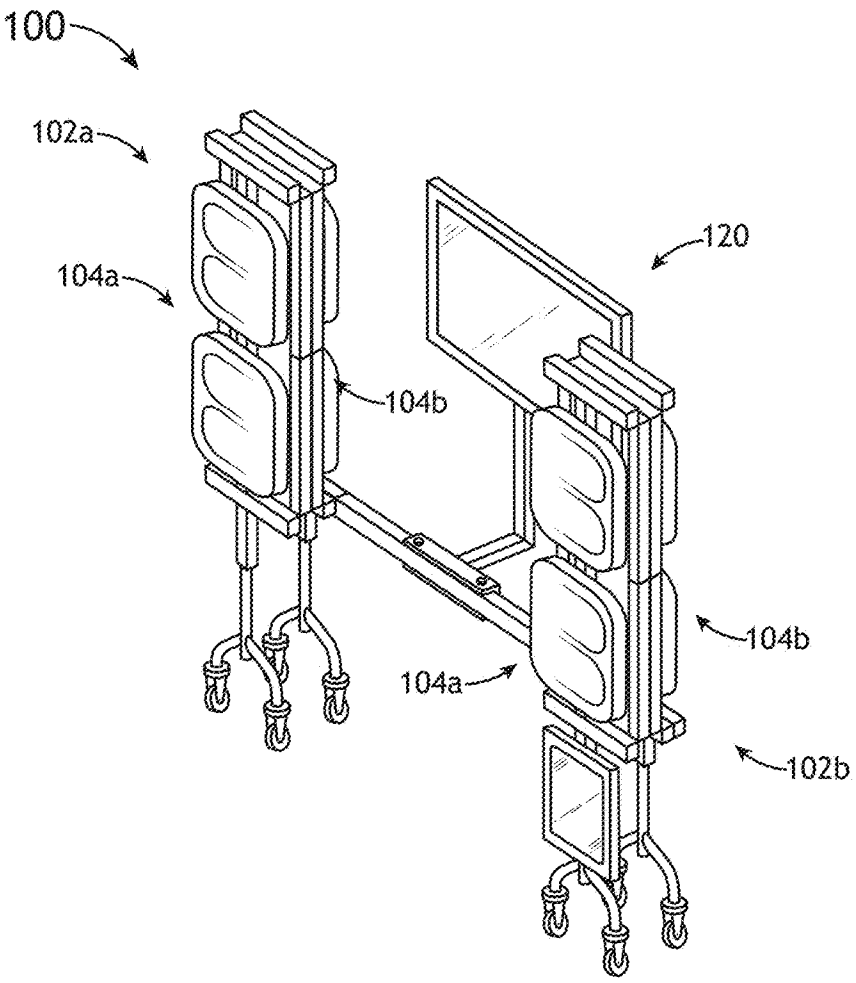
FIG. 2C illustrates a collapsed view of a collapsible and portable seating apparatus, in accordance with one or more embodiments of the present disclosure.

FIGS. 2A-2C illustrate an uncollapsed (or expanded) view, a partially-collapsed view, and a collapsed view of the collapsible and portable seating apparatus 100, in accordance with one or more embodiments of the present disclosure.

In one embodiment, the first set 104*a* of seats 106*a* and the second set 104*b* of seats 106*a* are actuated via motion in a direction 202. For example, the sets 104*a*, 104*b* of seats may be raised off the ground and into the air about an axis through the one or more hinge assemblies 112 coupling the first set 104*a* of seats and the second set 104*b* of seats. By way of another example, the wheeled-supports 114 may be pulled closer together as the sets 104*a*, 104*b* of seats are raised off the ground and into the air.

In another embodiment, the inner one or more supports 108 (e.g., close in proximity to the one or more hinge assemblies 112) of the sets 104*a*, 104*b* of seats are rotated about an axis through the corresponding one or more linkage assemblies 110 motion in direction(s) 204. For example, the inner supports 108 of the sets 104*a*, 104*b* of seats may be rotated about an axis through the corresponding linkage assemblies 110 such that the inner supports 108 come into contact with the support rails 106*b* of the sets 104*a*, 104*b* of seats.

In another embodiment, the outer supports 108 of the sets 104*a*, 104*b* of seats are rotated about an axis through the corresponding linkage assemblies 110 via motion in direction(s) 206. For example, the outer supports 108 of the sets 104*a*, 104*b* of seats may be rotated about an axis through the corresponding linkage assemblies 110 such that the outer supports 108 come into contact with the support rails 106*b* of the sets 104*a*, 104*b* of seats. By way of another example, the outer supports 108 of the sets 104*a*, 104*b* of seats may be rotated about an axis through the corresponding linkage assemblies 110 such that the outer supports 108 hang freely from the support rails 106*b* of the sets 104*a*, 104*b* of seats.

In another embodiment, as illustrated in FIG. 2C, the apparatus 100 is in a fully-collapsed form following the motion in the directions 202, 204, 206. In this regard, the apparatus 100 is transportable and/or storable in a compact form as compared to the apparatus 100 in a non-collapsed form as illustrated in FIG. 2A and/or a partially-collapsed form as illustrated in FIG. 2B.

Although embodiments of the present disclosure may be interpreted as actuating the components of the apparatus 100 via motions in directions 202, 204, 206 in a select listed order, it is noted herein the motions in directions 202, 204, 206 may occur in any order or simultaneously. In addition, although embodiments of the present disclosure may be interpreted as rotating the components of the apparatus 100 via the motions in directions 202, 204, 206 in a select rotational direction (e.g., clockwise or counter-clockwise about an axis through the one or more hinge assemblies 112), it is noted herein the motions in direction 202, 204, 206 may be in either rotational direction. Therefore, the above description should not be interpreted as a limitation on the scope of the present disclosure but merely an illustration.

Figure 3A:
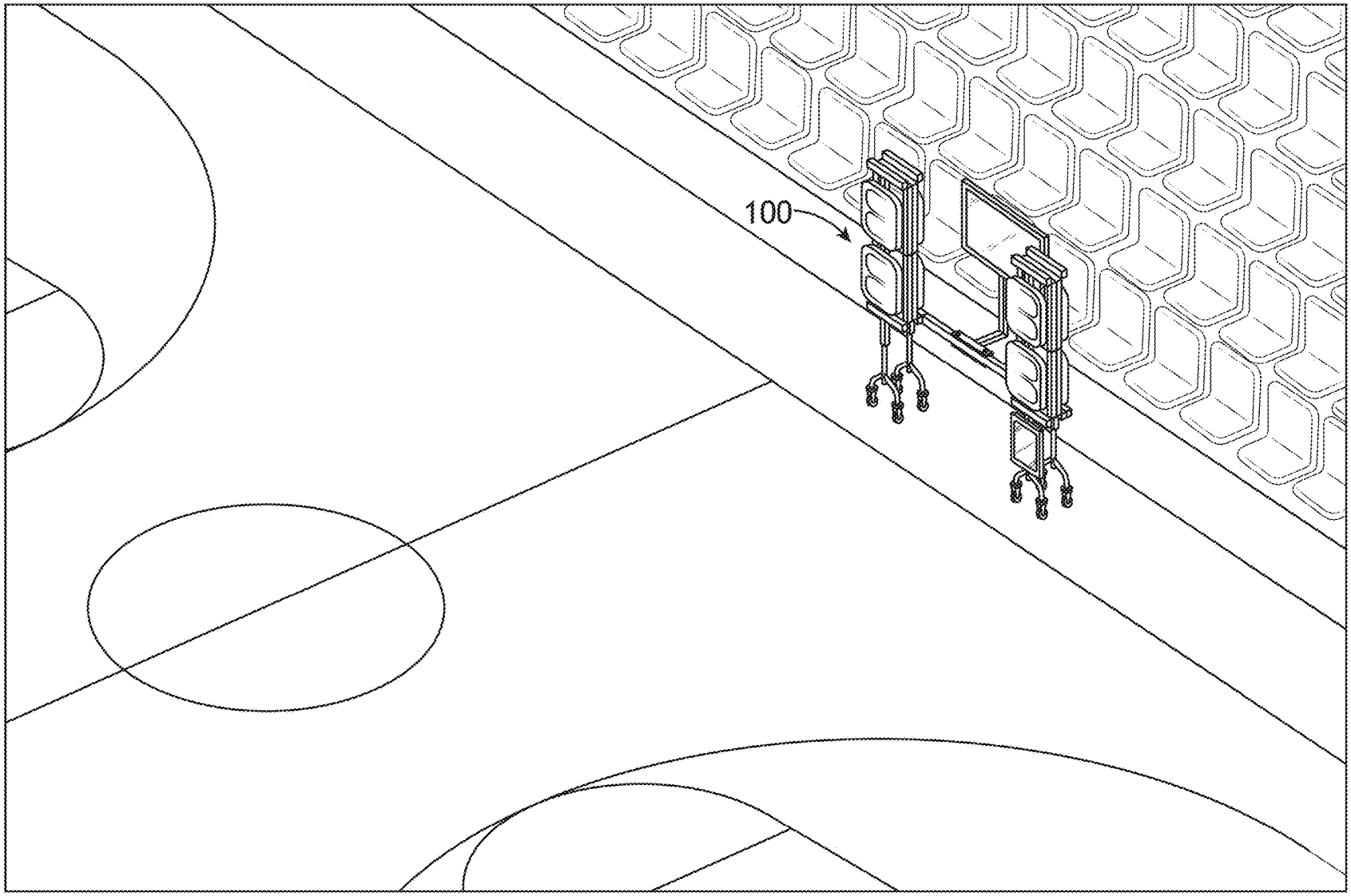
FIG. 3A illustrates a collapsible and portable seating apparatus located on a sideline of a basketball court and in a collapsed arrangement, in accordance with one or more embodiments of the present disclosure.
Figure 3B:
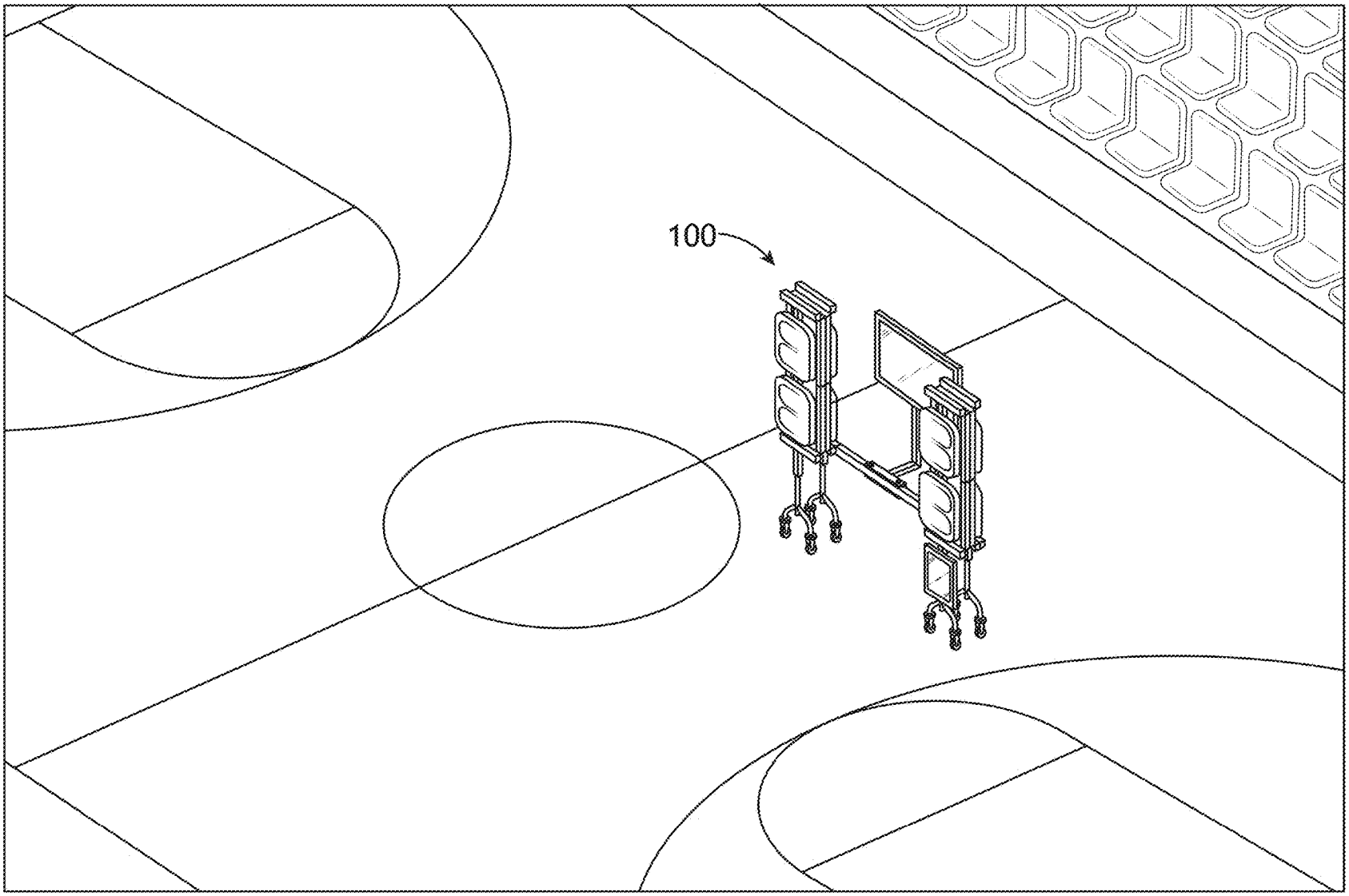
FIG. 3B illustrates a collapsible and portable seating apparatus located on a basketball court and in a collapsed arrangement, in accordance with one or more embodiments of the present disclosure.
Figure 3C:
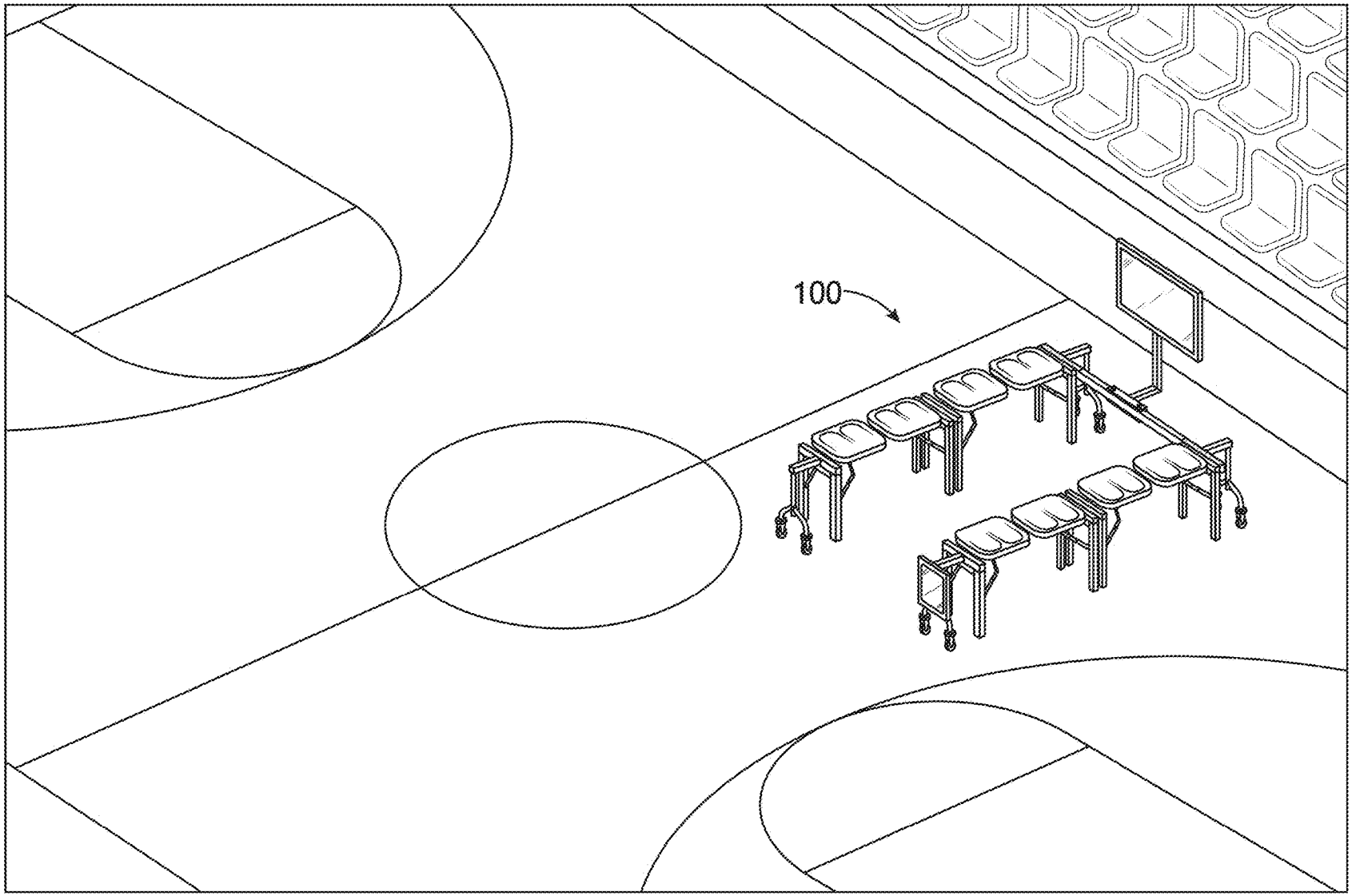
FIG. 3C illustrates a collapsible and portable seating apparatus located on a basketball court and in a non-collapsed arrangement, in accordance with one or more embodiments of the present disclosure.

In one embodiment, the apparatus 100 is usable in indoor environments. For example, the apparatus 100 may be used on indoor sports courts or fields. For instance, as illustrated in FIGS. 3A-3C, the apparatus 100 may be stored in a collapsed form on the sideline of a basketball court during gameplay, transported onto the court in the collapsed form during a time-out period, and set up in an uncollapsed, or expanded, form for use by the coach and players during the time-out period. By way of another example, the apparatus 100 may be usable in a cafeteria, a gymnasium, a lecture hall, a convention center, a field, indoor stadium, an ice rink, or any indoor location implementing movable and/or removable seating.

In another embodiment, the apparatus 100 is usable in outdoor environments. For example, the apparatus 100 may be used on an on an outdoor field, at an outdoor stadium, on a driveway, on a patio, in a backyard, or other outdoor area. For instance, outdoors gatherings may center around the viewing of a sports event or presentation on a display (e.g., a television or a screen). In this instance, the apparatus 100 may be implemented instead of taking down, setting up, dismantling, and/or re-arranging any indoor chairs, benches, tables, televisions, projector screens, and other necessary components. It is noted herein the collapsibility and portability of the apparatus 100 may provide a greater amount of ease in protecting any weather-sensitive components from being damaged should the weather change abruptly and/or without notice. By way of another example, the apparatus 100 may be usable on an outdoor sports field (e.g., football field, soccer field, baseball field, lacrosse field, ice rink, or the like), at a park, in a common green space, or any outdoor location implementing movable and/or removable seating.

In another embodiment, the apparatus 100 may include benches and/or seats for 1-16 people. In another embodiment, the apparatus 100 is modular, such that bench assemblies and/or seat assemblies may be added and/or removed as necessary without affecting the collapsible nature of the apparatus 100.

In another embodiment, the apparatus 100 includes components necessary to operate on power. For example, the apparatus 100 may be operated via one or more electrical power sources including, but not limited to, battery source, a grid-based electrical power source, or an electrical generator, such as a gas powered electrical generator, a solar powered generator, a wind powered generated, and the like. In another embodiment, the apparatus 100 includes components necessary for heating and/or cooling any of the components of the apparatus, including, but not limited to, the seats 106*a*, 106*b* and the one or more display assemblies 120. For example, the seats 106*a*, 106*b* may be equipped with one or more heater units (e.g., resistive heating elements) or one or more cooling elements (e.g., Peltier devices, fans, water cooling coils, etc.) By way of another example, the apparatus 100 may include slots within the one or more display assemblies 120 to provide airflow to components (e.g., components for the markable surface 122, the display device 124, and/or the controller) of the one or more display assemblies 120.

In another embodiment, the apparatus 100 includes one or more additional devices positionable between the bench assemblies 102*a*/102*b*. For example, the apparatus 100 may include a table or other substantially flat platform. By way of another example, the apparatus 100 may include a fire pit, grill, barbecue, or other backyard/patio accessory.

In another embodiment, the apparatus 100 includes an attached canopy or umbrella, and/or other shade-producing device. In another embodiment, the apparatus 100 includes a location to mount a canopy, umbrella, or other shade-producing device.

Figure 7B:
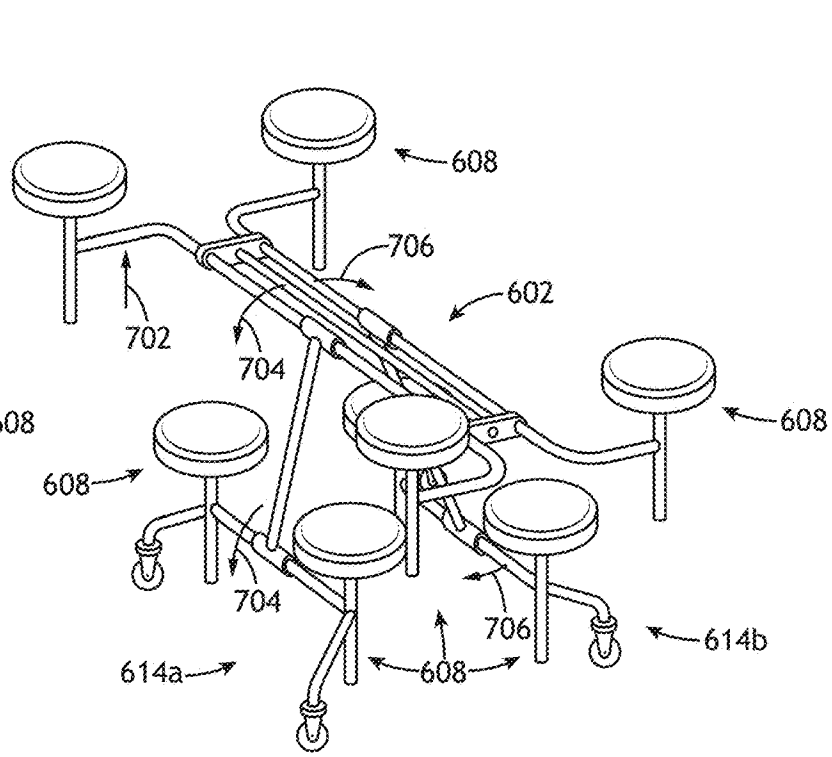
FIG. 7B illustrates a partially-collapsed view of a collapsible and portable seating apparatus, in accordance with one or more embodiments of the present disclosure.

Although embodiments of the present disclosure are directed to the apparatus 100 including one or more display assemblies 120, it is noted herein the apparatus 100 need not include a display assemblies 120 (e.g., see FIG. 7B, described in detail further herein). Therefore, the above description should not be interpreted as a limitation on the scope of the present disclosure but merely an illustration.

Figure 4:
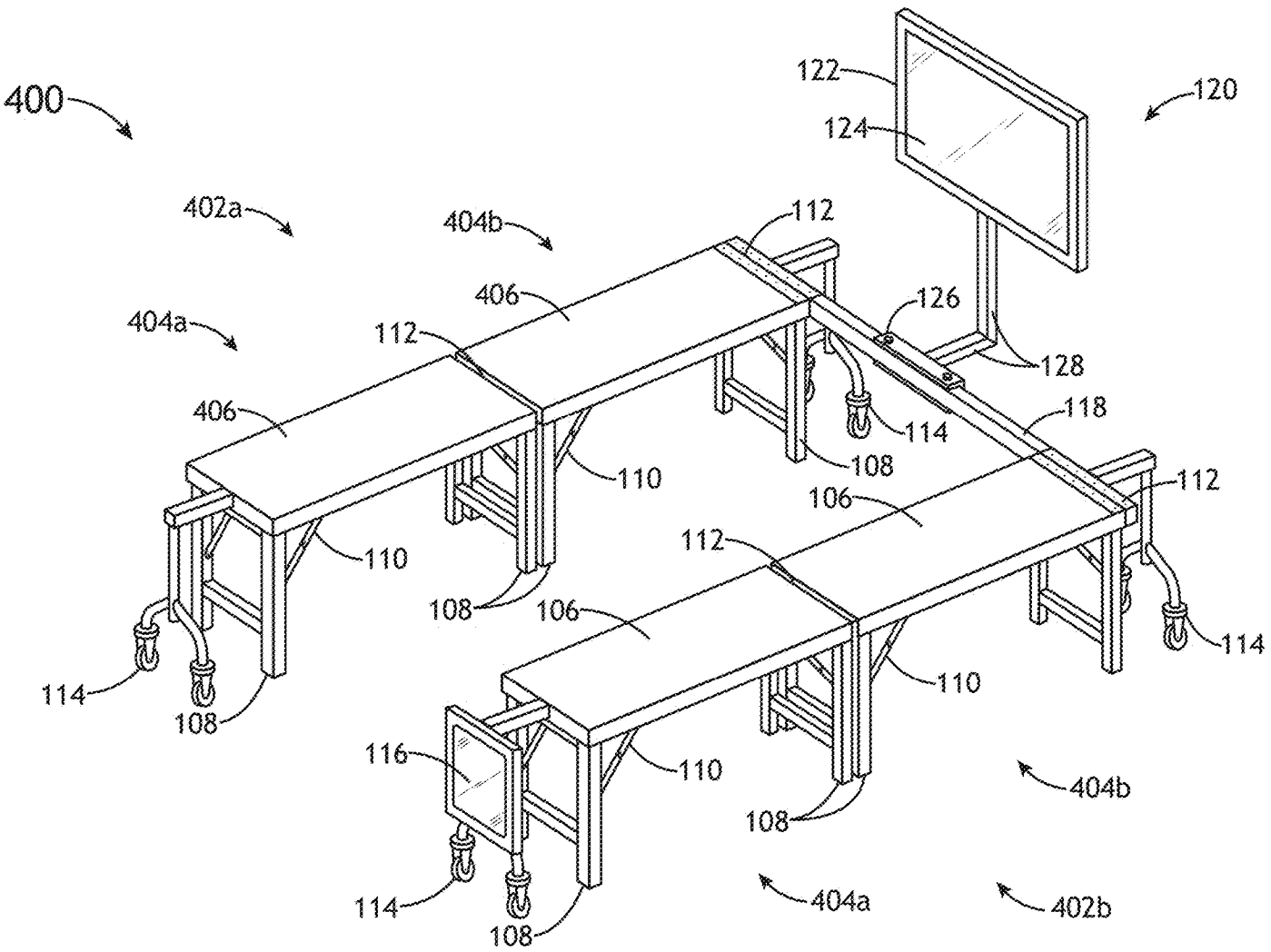
FIG. 4 illustrates a collapsible and portable seating apparatus, in accordance with one or more embodiments of the present disclosure.

FIG. 4 illustrates a collapsible and portable seating apparatus 400, in accordance with one or more embodiments of the present disclosure. It is noted herein that the description of the various embodiments of the apparatus 100 and/or components of the apparatus 100 may be extended to the apparatus 400 and/or components of the apparatus 400.

In one embodiment, the apparatus 400 includes one or more bench assemblies. For example, the apparatus 400 may include, but is not limited to, a first bench assembly 402*a* and a second bench assembly 402*b*. It is noted herein that the description of the embodiments of the first bench assembly 402*a* may be extended to the second bench assembly 402*b*.

In one embodiment, the first bench assembly 402*a* includes one or more benches. For example, the first bench assembly 402*a* may include, but are not limited to, a first bench 404*a* and a second bench 404*b*. It is noted herein that the description of the embodiments of the first bench 404*a* may be extended to the second bench 404*b*.

In another embodiment, the first bench 404*a* includes a platform 406, or seat. In another embodiment, the first bench 404*a* includes one or more cushions coupled to the platform 406.

In another embodiment, the apparatus 400 includes the one or more display assemblies 120. In another embodiment, the one or more display assemblies 120 are coupled to the support member 118 via the bracket 126 and the one or more display support members 128, where the support member 118 is coupled to the bench assemblies 402*a*, 402*b*. It is noted herein the one or more members 128 may be designed such that the one or more display assemblies 120 are orientated substantially perpendicular to the bench assemblies 402*a*, 402*b*. It is additionally noted herein the one or more display support members 128 may be designed such that the one or more display assemblies 120 are at a selected height from the ground (e.g., a height for comfortable viewing by users sitting on the bench assemblies 402*a*, 402*b*).

Figure 5:
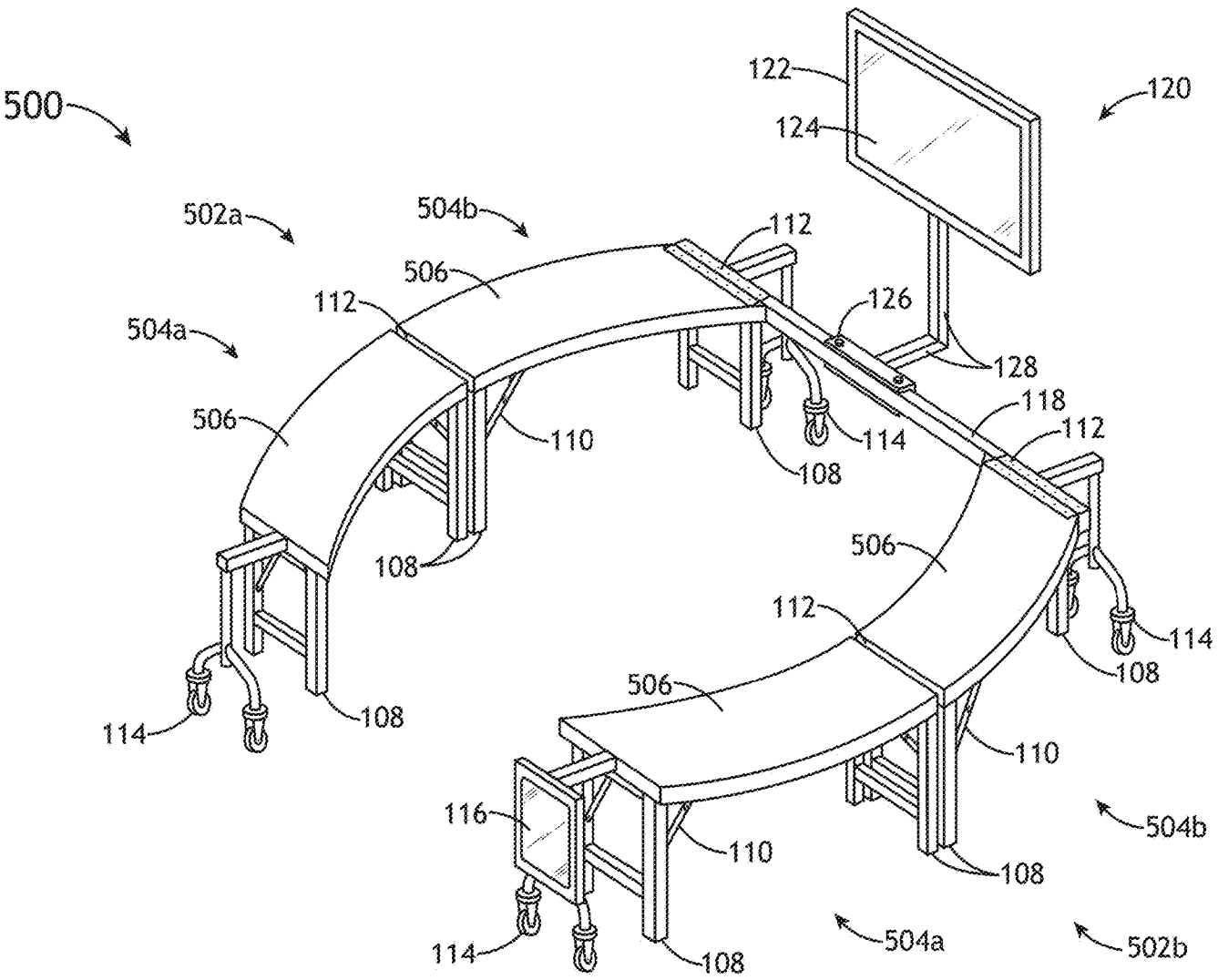
FIG. 5 illustrates a collapsible and portable seating apparatus, in accordance with one or more embodiments of the present disclosure.

FIG. 5 illustrates a collapsible and portable seating apparatus 500, in accordance with one or more embodiments of the present disclosure. It is noted herein that the description of the embodiments of apparatuses 100, 400 and/or components of the apparatuses 100, 400 may be extended to the apparatus 500 and/or components of the apparatus 500.

In one embodiment, the apparatus 500 includes one or more curved bench assemblies. For example, the apparatus 500 may include, but is not limited to, a first bench assembly 502*a* and a second bench assembly 502*b*. It is noted herein that the description of the embodiments of the first bench assembly 502*a* may be extended to the second bench assembly 502*b*.

In another embodiment, the first bench assembly 502*a* includes one or more curved benches. For example, the first bench assembly 502*a* may include, but are not limited to, a first bench 504*a* and a second bench 504*b*. It is noted herein that the description of the embodiments of the first bench 504*a* may be extended to the second bench 504*b*.

In another embodiment, the first bench 504*a* includes a platform 506. In another embodiment, the first bench 504*a* includes one or more cushions coupled to the platform 506. In another embodiment, the platform 506 is curved, as compared to the platforms 106 of the bench assemblies 402*a*, 402*b* of the apparatus 400. In this embodiment, there is a greater area between the bench assemblies 502*a*, 502*b* of the apparatus 500 than between the bench assemblies 402*a*, 402*b* of the apparatus 400.

In another embodiment, the apparatus 500 includes the one or more display assemblies 120 coupled to the support member 118 via the bracket 126 and the one or more display support members 128. In another embodiment, the one or more display assemblies 120 are coupled to the support member 118, where the support member 118 is coupled to the bench assemblies 502*a*, 502*b*. It is noted herein the one or more members 128 may be designed such that the one or more display assemblies 120 are orientated substantially perpendicular to the bench assemblies 502*a*, 502*b*. It is additionally noted herein the one or more members 128 may be designed such that the one or more display assemblies 120 are at a selected height from the ground (e.g., a height for comfortable viewing by users sitting on the bench assemblies 502*a*, 502*b*).

Figure 6:
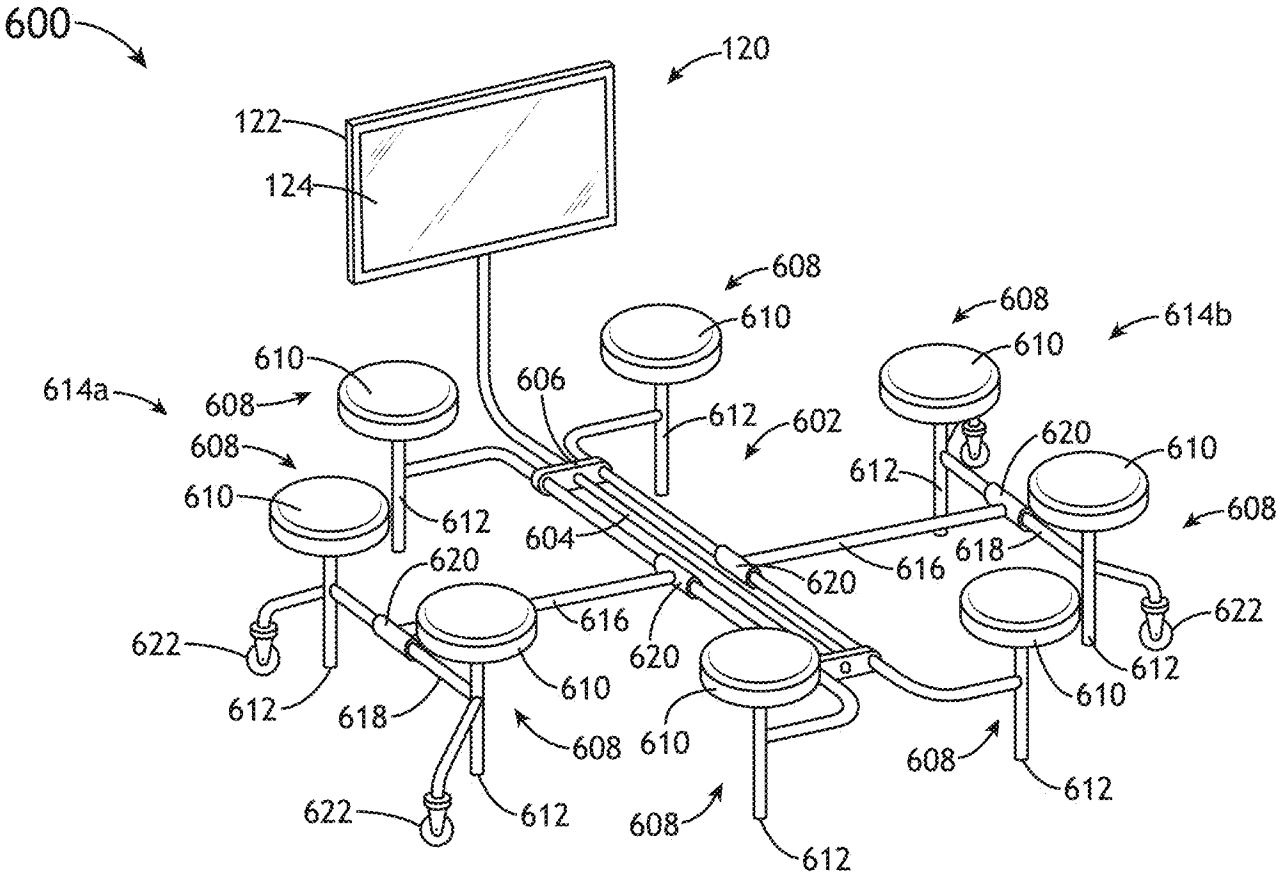
FIG. 6 illustrates a collapsible and portable seating apparatus, in accordance with one or more embodiments of the present disclosure.

FIG. 6 illustrates a collapsible and portable seating apparatus 600, in accordance with one or more embodiments of the present disclosure. It is noted herein that the description of the embodiments of the apparatuses 100, 400, 500 and/or components of the apparatuses 100, 400, 500 may be extended to the apparatus 600 and/or components of the apparatus 600.

In one embodiment, the apparatus 600 includes a main structure 602. In another embodiment, the main structure 602 includes one or more rails 604. It is noted herein the one or more rails 604 may include any cross-section known in the art. For example, the one or more rails 604 may include, but are not limited to, a circular cross-section, an elliptic cross-section, a polygonal cross-section (e.g., square, rectangle, triangle, hexagonal, etc.), or the like.

In another embodiment, the one or more rails 604 are held in place via one or more brackets 606. For example, the one or more rails 604 may pass through one or more holes in the one or more brackets 606. By way of another example, the one or more brackets 606 may clip onto, or otherwise be fastened to, the one or more rails 604.

In another embodiment, the main structure 602 includes one or more seat assemblies 608. In another embodiment, a seat assembly 608 includes a seat 610 coupled to a seat support 612. In another embodiment, the seat support 612 is coupled to the main structure 602. For example, the seat support 612 may be coupled to one or more extensions (e.g. a rail 604) of the main structures 602. By way of another example, the seat support 612 may be directly coupled to the main structure 602.

In another embodiment, the apparatus 600 includes one or more supplemental structures. For example, the apparatus 600 may include, but is not limited to, a first supplemental structure 614*a* and a second supplemental structure 614*b*. It is noted herein that the following description of the embodiments of the first supplemental structure 614*a* may be extended to the second supplemental structure 614*b*.

In another embodiment, the first supplemental structure 614*a* includes one or more rails 616 and/or one or more rails 618. In another embodiment, the first supplemental structure is collapsible via one or more joints 620. For example, the one or more joints 620 may be, but are not limited to, a T-shaped joint and/or a cross-shaped joint. In another embodiment, the one or more rails 616 and/or the one or more rails 618 couple to a leg of the one or more joints 620. In another embodiment, the one or more rails 616 and/or the one or more rails 618 pass through the one or more joints 620. In this regard, the one or more joints 620 may rotate around the one or more rails 616 and/or the one or more rails 618, such that the first supplemental structure 614*a* collapses into a position underneath and/or against the main structure 602.

In another embodiment, the first supplemental structure 614*a* includes one or more seat assemblies 608. For example, the one or more seat assemblies 608 may be coupled to the one or more rails 616 and/or the one or more rails 618 via the seat support 612. In another embodiment, the first supplemental structure 614*a* includes one or more wheeled-supports 622. For example, the one or more wheeled-supports 622 may be coupled to the one or more rails 616, the one or more rails 618, and/or the seat support 612 of the one or more seat assemblies 608. In this regard, the apparatus 600 may be transported and/or stored in an expanded or a compacted form with a minimized amount of effort by a user.

In another embodiment, the apparatus 600 includes the one or more display assemblies 120. In another embodiment, the one or more display assemblies 120 are directly coupled to a rail 604 of the main structure 602. In another embodiment, the one or more display assemblies 120 are coupled to a rail 604 of the one or more display assemblies 120 via a bracket and one or more members. It is noted herein the one or more display assemblies 120 may be coupled to the main structure 602 such that the one or more display assemblies 120 are orientated substantially perpendicular to the one or more seat assemblies 608. It is additionally noted herein the one or more display assemblies 120 may be coupled to the main structure 602 such that the one or more display assemblies 120 are at a selected height from the ground (e.g. a height for comfortable viewing by users sitting on the one or more seat assemblies 608).

Figure 7A:
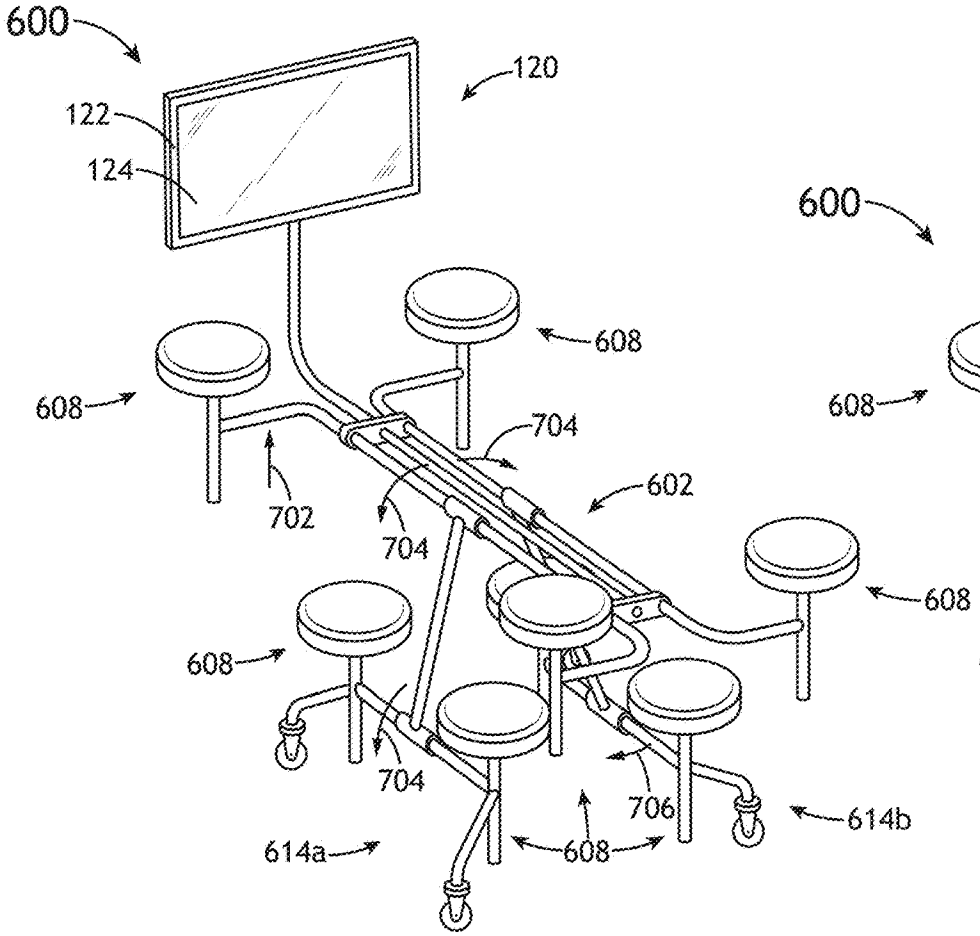
FIG. 7A illustrates a partially-collapsed view of a collapsible and portable seating apparatus, in accordance with one or more embodiments of the present disclosure.

FIGS. 7A and 7B illustrate a partially-collapsed view of the collapsible and portable seating apparatus 600, in accordance with one or more embodiments of the present disclosure.

In one embodiment, the main structure 602 is actuated via motion in direction 702. For example, the main structure 602 may be raised off the ground and into the air such that only components of the supplemental structures 614*a*, 614*b* touch the ground.

In another embodiment, actuating the main structure 602 via motion in the direction 702 causes the first supplemental structure 614*a* to rotate around one or more axes through the one or more joints 620 via motion in a direction 704, where the one or more joints 620 couple the one or more rails 616 to the main structure 602 and couple the one or more rails 618 to one or more rails 616. For example, the first bench 104*a* may be rotated about the one or more axes through the one or more joints 620 such that the first supplemental structure 614*a* collapses into a position underneath and/or against the main structure 602.

In another embodiment, actuating the main structure 602 via motion in the direction 702 causes the second supplemental structure 614*b* to rotate around one or more axes through the one or more joints 620 via motion in a direction 706, where the one or more joints 620 couple the one or more rails 616 to the main structure 602 and couple the one or more rails 618 to one or more rails 616. For example, the second supplemental structure 614*b* may be rotated about the one or more axes through the one or more joints 620 such that the second supplemental structure 614*b* collapses into a position underneath and/or against the main structure 602.

It is noted herein that actuation of the first supplemental structure 614*a* and the second supplemental structure 614*b* via motion in the directions 704, 706, respectively, may occur substantially simultaneously and/or separately in time.

In another embodiment, although not shown, the one or more display assemblies 120 may be configured to collapse against the main structure 602 via motion in a selected direction.

Although embodiments of the present disclosure may be interpreted as actuating the components of the apparatus 600 via motions in directions 702, 704, 706 in a select listed order, it is noted herein the motions in directions 702, 704, 706 may occur in any order or simultaneously. For example, the supplemental structures 614*a*, 614*b* may be collapsed into a position underneath and/or against the main structure 602 via motion in directions 704, 706, respectively, which causes the main structure 602 to be actuated via motion in the direction 702. Therefore, the above description should not be interpreted as a limitation on the present disclosure but merely an illustration. In addition, although embodiments of the present disclosure may be interpreted as rotating the components of the apparatus 100 via the motions in directions 702, 704, 706 in a select rotational direction (e.g., clockwise or counter-clockwise relative to an axis through the one or more joints 620), it is noted herein the motions in directions 702, 704, 706 may be in either rotational direction. For example, the supplemental structures 614*a*, 614*b* may be collapsed into a position above and/or against the main structure 602 such that only components of the main structure 602 are touching the ground. Therefore, the above description should not be interpreted as a limitation on the present disclosure but merely an illustration.

One skilled in the art will recognize that the herein described components, devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components, devices, and objects should not be taken limiting.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

The herein described subject matter sometimes illustrates different components contained within, or connected with, different other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components, and/or wirelessly interactable, and/or wirelessly interacting components, and/or logically interacting, and/or logically interactable components.

In some instances, one or more components may be referred to herein as "configured to," "configurable to," "operable/operative to," "adapted/adaptable," "able to," "conformable/conformed to," etc. Those skilled in the art will recognize that such terms (e.g., "configured to") can generally encompass active-state components and/or inactive-state components and/or standby-state components, unless context requires otherwise.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B.

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. Accordingly, the scope of the invention should be limited only by the claims appended hereto.

What is claimed:

1. An apparatus comprising:

two or more seat assemblies, wherein a first seat assembly is mechanically coupled to a second seat assembly, wherein each seat assembly includes a hinge assembly;

a display assembly mechanically coupled to the two or more seat assemblies, wherein the display assembly includes a display device; and two or more wheeled-supports, wherein the two or more wheeled-supports are mechanically coupled to the two or more seat assemblies, wherein the two or more seat assemblies are collapsible at the hinge assemblies of the two or more seat assemblies, wherein the two or more seating assemblies and the display assembly are portable via the one or more wheeled supports, wherein the display assembly is mechanically coupled to a horizontal support member via a display support member and a bracket.

2. The apparatus in claim 1, wherein each seat assembly comprises a first set of seats and a second set of seats.

3. The apparatus of claim 2, wherein the hinge assembly of each seat assembly is disposed between the first set of seats and the second set of seats.

4. The apparatus in claim 3, wherein each seat assembly comprises one or more support rails, wherein the hinge assembly of each seat assembly is disposed between a first support rail and a second support rail.

5. The apparatus in claim 2, wherein each seat assembly comprises one or more supports, wherein the one or more supports are mechanically coupled to the one or more support rails via one or more linkage assemblies.

6. The apparatus in claim 1, wherein each seat assembly comprises a first bench and a second bench.

7. The apparatus of claim 6, wherein the hinge assembly of each seat assembly is disposed between the first bench and the second bench.

8. The apparatus in claim 6, wherein the first bench and the second bench are curved.

9. The apparatus in claim 1, wherein the first seat assembly and the second seat assembly are mechanically coupled via a horizontal support member.

10. The apparatus in claim 1, wherein the display support member comprises an articulating display support member.

11. The apparatus in claim 1, wherein the two or more seat assemblies and the two or more wheeled-supports are configured to raise one or more wheels of the two or more wheeled-supports off of the ground and engage one or more supports of the two or more seat assemblies with the ground when in an uncollapsed configuration.

12. The apparatus in claim 1, further comprising:

a user interface device communicatively coupled to the display device of the display assembly.

13. The apparatus in claim 12, wherein the user interface device comprises:

at least one of a tablet, a smartphone, a laptop, an ultrabook, or a digital pen.

14. The apparatus in claim 1, wherein the display assembly comprises:

one or more markable surfaces.

15. An apparatus comprising:

a first seat assembly, wherein the first seat assembly includes a first set of seats and a second set of seats;

a second seat assembly, wherein the second seat assembly includes a third set of seats and a fourth set of seats;

a first hinge assembly disposed between the first set of seats and the second set of seats of the first seat assembly;

a second hinge assembly disposed between the third set of seats and the fourth set of seats of the second seat assembly;

a display assembly, wherein the display assembly includes a display device;

a horizontal support member configured to mechanically couple the first seat assembly to the second seat assembly and further configured to support the display assembly;

a first set of wheeled-supports, wherein the first set of wheeled-supports are mechanically coupled to the first seat assembly; and a second set of wheeled-supports, wherein the second set of wheeled-supports are mechanically coupled to the second seat assembly, wherein the first seat assembly and the second seat assembly are collapsible at the first hinge assembly and the second hinge assembly, wherein the two or more seating assemblies and the display assembly are portable via the one or more wheeled supports, wherein the first seat assembly, the second seat assembly, the first set of wheeled-supports, and the second set of wheeled-supports are configured to raise one or more wheels of the two or more wheeled-supports off of the ground and engage one or more supports of the two or more seat assemblies with the ground when in an uncollapsed configuration.

16. The system in claim 15, further comprising:

a user interface device communicatively coupled to the display device of the display assembly.

17. The system in claim 16, wherein the user interface device comprises:

at least one of a tablet, a smartphone, a laptop, an ultrabook, or a digital pen.

18. The system in claim 15, wherein the display assembly comprises:

one or more markable surfaces.

19. An apparatus comprising:

two or more seat assemblies, wherein a first seat assembly is mechanically coupled to a second seat assembly, wherein each seat assembly includes a hinge assembly;

a display assembly mechanically coupled to the two or more seat assemblies, wherein the display assembly includes a display device and one or more markable surfaces;

a user interface device, wherein the user interface device is communicatively coupled to the display device of the display assembly; and two or more wheeled-supports, wherein the two or more wheeled-supports are mechanically coupled to the two or more seat assemblies, wherein the two or more seat assemblies are collapsible at the two or more hinged assemblies and the two or more seat assemblies, wherein the two or more seating assemblies and the one or more display assemblies are portable via the one or more wheeled supports, wherein the two or more seat assemblies and the two or more wheeled-supports are configured to raise one or more wheels of the two or more wheeled-supports off of the ground and engage one or more supports of the two or more seat assemblies with the ground when in an uncollapsed configuration.

* * * * *